US007862193B1

(12) United States Patent
Quittner

(10) Patent No.: US 7,862,193 B1
(45) **Date of Patent: *Jan. 4, 2011**

(54) COMPACT FLASHLIGHT

(76) Inventor: Brian Quittner, P.O. Box 6942, Goleta, CA (US) 93160

( * ) Notice: Subject to any disclaimer, the term of this patent is extended or adjusted under 35 U.S.C. 154(b) by 179 days.

This patent is subject to a terminal disclaimer.

(21) Appl. No.: 12/355,849

(22) Filed: Jan. 19, 2009

Related U.S. Application Data

(63) Continuation of application No. 11/953,708, filed on Dec. 10, 2007, now Pat. No. 7,497,584, which is a continuation of application No. 11/271,227, filed on Nov. 12, 2005, now Pat. No. 7,306,348, which is a continuation-in-part of application No. 10/248,064, filed on Dec. 13, 2002, now Pat. No. 7,021,783.

(60) Provisional application No. 60/319,032, filed on Dec. 14, 2001.

(51) Int. Cl.
*F21V 21/08* (2006.01)

(52) U.S. Cl. ..... 362/103; 362/205

(58) Field of Classification Search ..... 362/103, 362/108, 130, 205, 253, 800
See application file for complete search history.

(56) References Cited

U.S. PATENT DOCUMENTS

| | | | | |
|---|---|---|---|---|
| 3,953,722 | A | 4/1976 | Stick | |
| 4,234,913 | A | 11/1980 | Ramme | |
| 4,605,990 | A | 8/1986 | Wilder et al. | |
| D292,616 | S | 11/1987 | Sexton | |
| 4,953,892 | A | 9/1990 | Adkins | |
| 4,974,130 | A | 11/1990 | Friedman | |
| 5,029,055 | A | 7/1991 | Lindh | |
| 5,183,324 | A | 2/1993 | Thomas | |
| D340,777 | S | 10/1993 | Choi et al. | |
| D350,618 | S | 9/1994 | Parker | |
| 5,410,457 | A | 4/1995 | Parker | |
| D362,312 | S | 9/1995 | Chen | |
| 5,541,816 | A | 7/1996 | Miserendino | |
| D383,558 | S | 9/1997 | Parker | |
| 5,871,272 | A * | 2/1999 | Sharrah et al. | 362/184 |
| 6,012,824 | A | 1/2000 | Sharrah et al. | |
| 6,027,223 | A | 2/2000 | Lackey et al. | |
| 6,213,618 | B1 | 4/2001 | Dobbin et al. | |
| 6,250,771 | B1 | 6/2001 | Sharrah et al. | |
| 6,299,323 | B1 | 10/2001 | Yu et al. | |
| 6,474,830 | B1 | 11/2002 | Hansen | |

(Continued)

OTHER PUBLICATIONS

Letter from Charles Berman, Esq. of Greenberg Traurig on Behalf of Pelican Products, Inc., dated Jul. 10, 2008.

(Continued)

*Primary Examiner*—John A Ward
(74) *Attorney, Agent, or Firm*—Intellectual Property Law; Offices of Joel Voetzke, APC

(57) ABSTRACT

A compact flashlight that allows a user to view documents in a dark situation without having to hold a flashlight. The pocket light fits easily over the top of the pocket and can be covered by a conventional pocket flap. The light is an LED display device that produces a significant amount of light so a user can check identification or documentation, as in a license check, or registration verification for police. The pocket light has a push button power switch that can be activated by the user through the fabric of their shirt.

20 Claims, 4 Drawing Sheets

U.S. PATENT DOCUMENTS 6,523,972 B2 2/2003 Sharrah et al.
6,533,436 B2 3/2003 Krietzman et al.
6,612,714 B1 9/2003 Morre et al.
7,306,348 B2 * 12/2007 Quittner ..... 362/103
2002/0163800 A1 11/2002 Hansen

OTHER PUBLICATIONS

Photographs of VB3 Flashlight Sold by Pelican Products, Inc., believed to have been on sale by Nov. 1, 2004.

* cited by examiner

COMPACT FLASHLIGHT

CROSS-REFERENCE TO RELATED APPLICATIONS

This application is a continuation of U.S. patent application Ser. No. 11/953,708 filed Dec. 10, 2007, now U.S. Pat. No. 7,497,584, which is a continuation of U.S. patent application Ser. No. 11/271,227 filed Nov. 12, 2005, now U.S. Pat. No. 7,306,348, which is a continuation-in-part of U.S. patent application Ser. No. 10/248,064 filed Dec. 13, 2002, now U.S. Pat. No. 7,021,783, which claims benefit of U.S. Provisional Application No. 60/319,032 filed Dec. 14, 2001.

BACKGROUND OF THE INVENTION

1. Field of the Invention

The present invention is a compact flashlight that has an attachment means for fitting on a shirt pocket.

2. Description of Related Art

The use of flashlights is imperative to security guards and police for patrolling and checking identification and documentation. Often the police officer or security guard carries the flashlight on his belt in a holster or clip. However in this situation the user must unhook the flashlight, and position the flashlight in a proper position to see the documentation. Often this includes tucking the flashlight in the fold of the arm at the armpit against the body. The inherent problem with this situation includes lack of use of the hand on the arm holding the flashlight, or trying to juggle documentation and the flashlight in the same hand, or having no hands free while holding the documentation in one hand and the flashlight in the other hand.

U.S. Pat. No. 3,953,722 issued to Stick on Apr. 27, 1976 shows a flashlight support means. Stick's invention is unlike the present invention because it is attached to the wearer by a safety pin, it is larger than the present invention, and the light would not fit under a shirt pocket flap.

U.S. Pat. No. 4,605,990 issued to Wilder, et al. on Aug. 12, 1986 shows a surgical clip-on light pipe illumination assembly. Wilder's invention is unlike the present invention because the clip is a hinged mechanism that is not as discreet or hidden as the present invention, and the light mechanism cannot be hidden under a shirt pocket flap.

U.S. Design Pat. No. D292,616 issued to Sexton on Nov. 3, 1987 shows a disposable clip light. Sexton's invention is unlike the present invention because when clipped it could not light in a downward direction as is needed to read documentation, and cannot fit underneath a shirt pocket flap.

U.S. Pat. No. 5,029,055 issued to Lindh on Jul. 2, 1991 shows a portable light. Lindh's invention is unlike the present invention because it is intended to be mounted on a bicycle, would not clip onto a shirt pocket, and would not be covered by the flap on a shirt pocket.

U.S. Design Pat. No. D340, 777 issued to Choi, et al. on Oct. 26, 1993 shows a personal safety light. U.S. Design Pat. No. D362,312 issued to Chen on Sep. 12, 1995 shows a clip-on flashlight. Choi and Chen's inventions are unlike the present invention because they are bulkier, and cannot be easily hidden by a pocket flap as the present invention.

U.S. Pat. No. 4,953,892 issued to Adkins on Sep. 4, 1990 shows a ski pole clip. Adkins' invention is unlike the present invention because it does not have a light mechanism, and it would not fit in a pocket to light identification or documentation.

U.S. Pat. No. 5,541,816 issued to Miserendino on Jul. 30, 1996 shows a clip light source. Miserendino's invention is unlike the present invention because it is a flashlight intended to be attached to a helmet as for a miner or fireman, it cannot be covered by a shirt pocket flap, and it has a hinged mechanism for the light that is bulkier than the present invention.

U.S. Pat. No. 6,027,223 issued to Lackey, et al. on Feb. 22, 2000 shows a writing instrument pocket clip light. Lackey's invention is unlike the present invention because it is a writing instrument, and the light needs to be activated by unfolding the pen clip requiring additional hand coordination.

Therefore, a need has been established for a flashlight that can be hidden by a shirt pocket flap, which can assist policemen or security officers in viewing documents.

INVENTION SUMMARY

The present invention is a light that an officer or security guard could wear on his shirt pocket that projects a light in a downward direction. The light is compact and fits in a shirt pocket with a clip mechanism. The main body of the pocket light will fit inside a shirt pocket and there is a 1⅜ inch overlap from the front of the pocket that holds the light source. The pocket light mechanism is completely concealed within the user's pocket and cannot be seen on the wearer until the light source is turned on, which is advantageous because it allows an officer to conform his appearance to the approved regulation appearance of his department. The main body of the light source encases the power source for the light and a push switch for turning the light on or off. The push button is sensitive enough to be pushed through the fabric of a shirt pocket and turn the light on or off. In this manner the user can turn on the light and view any documents or light his way in a dark area, such as a theater isle. The present invention is useful to police officers, security guards, ushers, and bouncers at nightclubs or the like.

The light projects at an approximate 30 degree outward and downward angle. Due to the approximate 30 degree angle the user can hold the documents that need to be read or viewed in his hand at a natural angle without having to place the documents directly underneath the light. Additionally, a hinged member allows the user to move the light up to a 90 degree angle or even up to a 180 degree angle from the main body of the pocket light, allowing for different angles of viewing capacity for the user. Although the light bulb is small and compact, the projection ray of the light is wide enough to project onto a letter sized document easily, and concentrated to make small print reading easier.

Advantages to the present invention include hands free use and quick access to a light source. The user can turn on the light through his shirt pocket with the push of a finger and the light can project easily from the underside of the shirt pocket flap allowing the user to have both hands free for handling documents. Currently, with conventional flashlights the user must keep one hand free to operate the flashlight and to hold the flashlight during use.

Exemplary embodiments of the invention will be further described below with reference to the drawings, in which like numbers refer to like parts.

DETAILED DESCRIPTION OF THE PREFERRED EMBODIMENTS

The present invention is a pocket light for viewing documents or merely lighting one's way without having to use a hand held flashlight. The pocket light is small and thin in size to easily fit in any shirt pocket and still leave room for other items. An exemplary embodiment of the present invention is preferably made of a high-density or composite type plastic shell casing; a pair of batteries; a power button; a Light Emitting Diode (LED) lamp emitting red, blue or white light; and a flap mechanism for securing the present invention to a pocket in a secure yet removable fashion.

Figure 1:
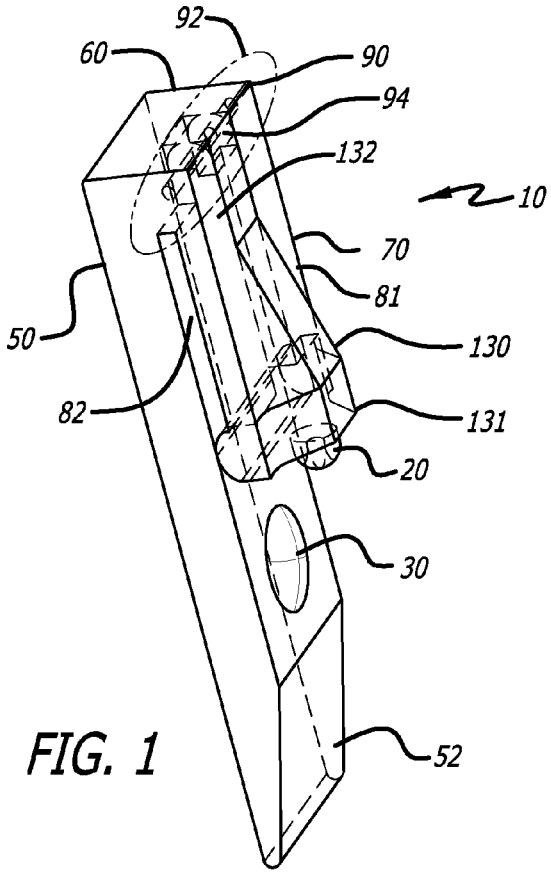
FIG. 1 shows an environmental view of a first embodiment of the present invention.
Figure 4:
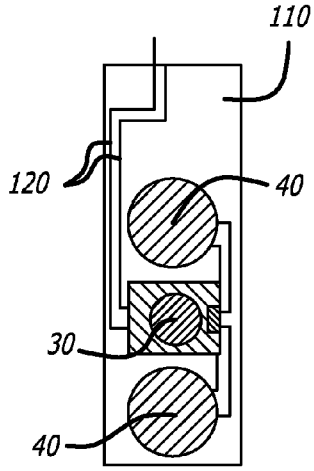
FIG. 4 shows a back view of a first embodiment of the present invention.

FIG. 1 shows an environmental view of the pocket light (10) according to a first exemplary embodiment having a single LED lamp. The LED light display (20) is located on the outer casing (70) facing in an approximate 30 degree angle from the elongated back casing (50). That is, the LED light emitting member (20) is angled relative to elongated outer member (130) such that the light from the LED projects at an outward angel of approximately 30 degrees when the outer member (130) is rotated fully downward. The angling of LED (20) relative to the outer member (130) is additionally illustrated in FIG. 8. The power switch (30) is activated by depressing the switch to activate or deactivate the LED light display (20). The power switch (30) is attached via a wiring system (FIG. 4, 120) connect to a circuit board (FIG. 4, 110) and to a pair of batteries (40). The batteries (40) are long life lithium batteries that can easily be changed through the rear protective door (100) back casing (50), as shown in FIG. 4. In this embodiment the batteries (40) are 3 volts each that supply the LED light with a total of six volts.

The back casing (50) is fixedly connected to the outer casing (70) by a clip member (60). The clip member (60) fastens across the top of a shirt pocket and can easily be concealed by a pocket flap. The clip member (60) communicates with a hinged member (90) to allow the user to move the LED light display (20) up to a 90 degree angle (FIG. 3) from the shirt pocket (not shown). The hinged member (90) can be of a conventional receptor and screw mechanism as in the arm of a pair of glasses. The clip member top (60) is fastened to the back casing (50) and is non-adjustable, and is 1/16 inch thick where it communicates with the outer casing (70). The LED light display (20) is situated, in FIG. 1, at an approximate 30 degree angle from the shirt pocket and the outer casing (70), and is therefore at the correct front facing and downward angle to view documents without additional adjustment of the light. The movable pocket light (10) could also be used in alternate embodiments from a car dashboard or at a crime scene investigation to light pieces of evidence. The LED light display (20) is designed to last thousands of hours before total burn out, allowing the wearer to have long-term use of the pocket light (10).

The outer member (130) that holds the LED lamp (20) or other type of lamp proximate its distal end (131) is connected to the main body (50) by the hinged member (90) that rotates about hinge (94). The area where outer member (130) connects to main body (50) defines a connection zone (92), connection zone (92) being located at the respective top portions of each of main body (50) and outer member (130). An elongated clip (80), which is more clearly visible in FIG. 3, includes two clip arms (81 and 82). As seen in FIG. 1 outer member (130), when rotated downward so as to be folded toward main body (50) as shown in the figure, rests partially between clip arms (81, 82) of clip (80), contributing to the overall thinness of the design. The overall thinness of the design, including the combined thicknesses of the respective top portions of main body (50) and outer member (130), allows pocket light (10) to be easily worn in a shirt pocket with the outer member (130) concealed by the shirt pocket flap. As can be further seen in the figure, outer member (130) has a bottom end or distal end (131) that is thick enough to hold LED lamp (20), and has an upper end (132) that is thinner than the bottom end (131). The thinner top end (132) contributes to the ability of a shirt pocket flap to hang generally flat and downward over outer member (130). As can also be seen in the figure, main body (50) also has a tapered, chisel shaped bottom end (52). The chisel shaped bottom end allows main body (50) to easily be inserted into a shirt pocket. As can be further seen in the figure, power switch (30) is located on the outward facing surface of main body (50) when the pocket light is inserted into a pocket. The power switch (30) is located lower on main body (50) than a lowermost extension of the outer member (130), which allows the user to activate power switch (30) even when the outer member (130) is rotated downward so as to be in close proximity to main body (50) as shown in the figure. That is, the lamp holding outer member (130) does not block a user's access to power switch (30). As can be further seen in the figure, a distal most extent of LED (20), which is not covered in the embodiment shown, extends beyond an immediately adjacent distal most extent (134) of outer member (130). As can be yet further seen in the figure, the rotating outer member (130) which holds LED (20) proximate its distal end (131) is about half as long as the main body (50).

As can be seen in the FIG. 1, main body (50) is generally planer, includes at least one flat surface, and is substantially thinner than it is long and wide. That is, the thickness dimension is substantially smaller than the length and width dimension. Similarly, the rotatable outer member (130) that holds the LED lamp (20) at its distal end (131) is generally planar, and is substantially thinner than it is long and wide. The distal end of LED lamp (20) defines the distal most extension of outer member (130). As can be seen from FIGS. 1 and 2 taken together, the combined main body and rotatable member are thinner than the main body is long and wide. As can be seen further in FIGS. 1 and 2, when outer member (130) is rotated downward towards its position closest to main body (50), outer member (130) lies generally parallel to main body (50).

Figure 2:
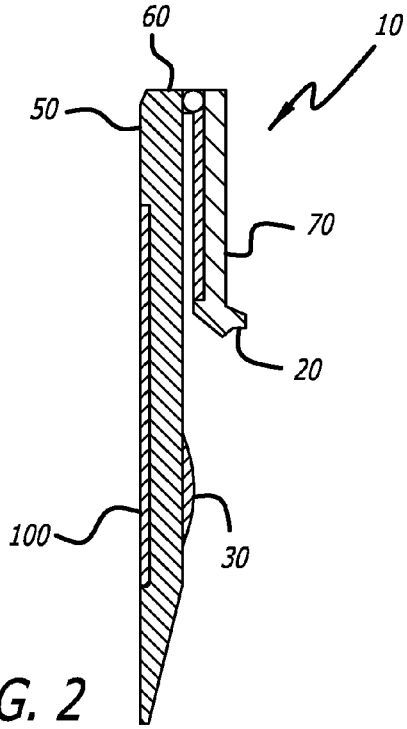
FIG. 2 shows a side view of a first embodiment of present invention.

Turning to FIG. 2 we have a clear view of the side of the pocket light (10). FIG. 2 shows the sleek design of the pocket light and the separate members as described above. The outer casing (70), clip member top (60), back casing (50), rear protective plate (100), LED display light (20) and power switch (30) of the pocket light are each shown in FIG. 2. The rear protective plate (100) protects the batteries (40) and circuit board (110) from moisture or dust. The rear protective plate (100) is easily removable to replace the batteries (40) or wiring (not shown) as necessary. The outer casing (70), back casing (50), rear protective plate (100) and clip member (80) are made of a high density plastic composite, or an aluminum alloy which is water resistant and durable for extended use of the pocket light (10). In separate embodiments of the pocket light (10) the back casing (50), exterior casing (70), clip member (60) and rear protective plate (100) could be constructed in a waterproof manner.

Figure 3:
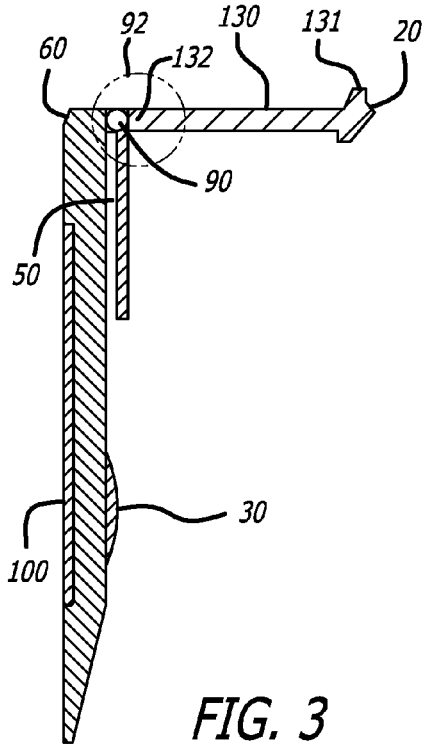
FIG. 3 shows a side view of a first embodiment of the present invention with the exterior casing extended.

FIG. 3 shows a side view of the pocket light (10) with the exterior casing (70) fully extended at an approximate 90 degree angle from the rear casing (50) and level with the clipping member top (60). The hinged member (90) allows the user to lock the exterior casing (70) in this position, or at any angle between the closed angle (FIG. 2) and the fully extended angle (FIG. 3), to allow a user to point the light at a desired angle relative to the user's body while the main body (50) of the pocket light remains within the shirt pocket. Also shown in FIG. 3 are the power switch (30), LED light display (20), rear casing (50) and rear protective plate (100) previously detailed. Clip (80) connects to main body (50) and outer member (130) at connection zone (92), such that the top portions of each of main body (50), clip (80), and outer member (130) all connect together at connection zone (92) and all extend therefrom. As can be readily inferred from FIGS. 2 and 3, when pocket light (10) is placed within a shirt pocket main body (50) and clip (80) cooperate to hold pocket light (10) to the shirt pocket, main body (50) is disposed primarily within the pocket; outer member (130) and clip (80) are disposed primarily outside of the pocket, and connection zone (92) is disposed at the top edge of the pocket. The connection zone (92) could rest on the top of the pocket or, if clip (80) and main body (50) are sufficiently close together or the shirt fabric is sufficiently thick such that the shirt fabric is held tightly, connection zone (92) could be held slightly above the top edge of the shirt pocket fabric.

FIG. 4 shows a rear view of the pocket light (10). As is shown the batteries (40) are covered by a rear protective plate (FIG. 2, 100), which can be removed to replace the batteries (40) as necessary. The batteries (40) are connected via wiring (120) to the power switch via circuit board assembly (110) to activate the LED display (20). The power switch (30) is touch sensitive and the user can easily activate the light through the material of a shirt pocket with a push of a finger. The wiring (120) will act as negative and positive charge connectors from each functioning component to the batteries (40) and circuit board (110). The wiring (120) also feeds power source from the batteries (40) to the LED light display (20). The series of wiring (120) are easily manipulated without damage of the circuit board (110) or other interior components of the pocket light (10). The pocket light (20) has an automatic shut off so the LED light display (20) will burn 5 minutes and shut off to minimize depletion of the batteries (40). Alternatively, the automatic turn-off time can be adjusted by the user.

Figure 5:
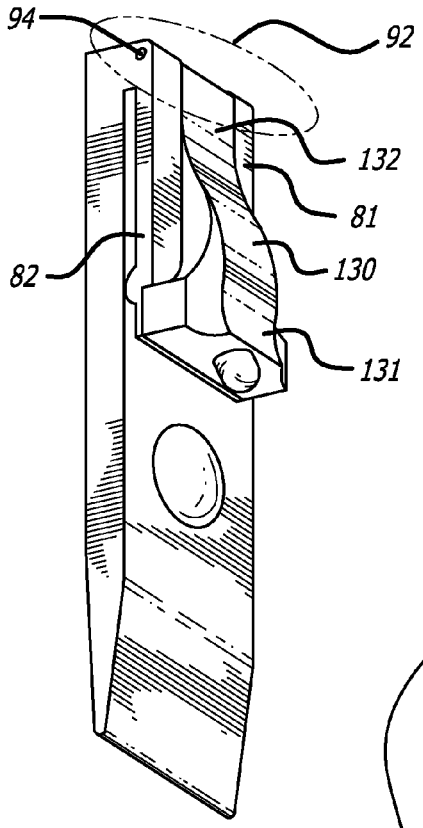
FIG. 5 is another illustration of the first embodiment of the present invention.

FIG. 5 shows the basic embodiment of FIG. 1 with minor shape changes and all solid lines for clarity of illustration.

Figure 6:
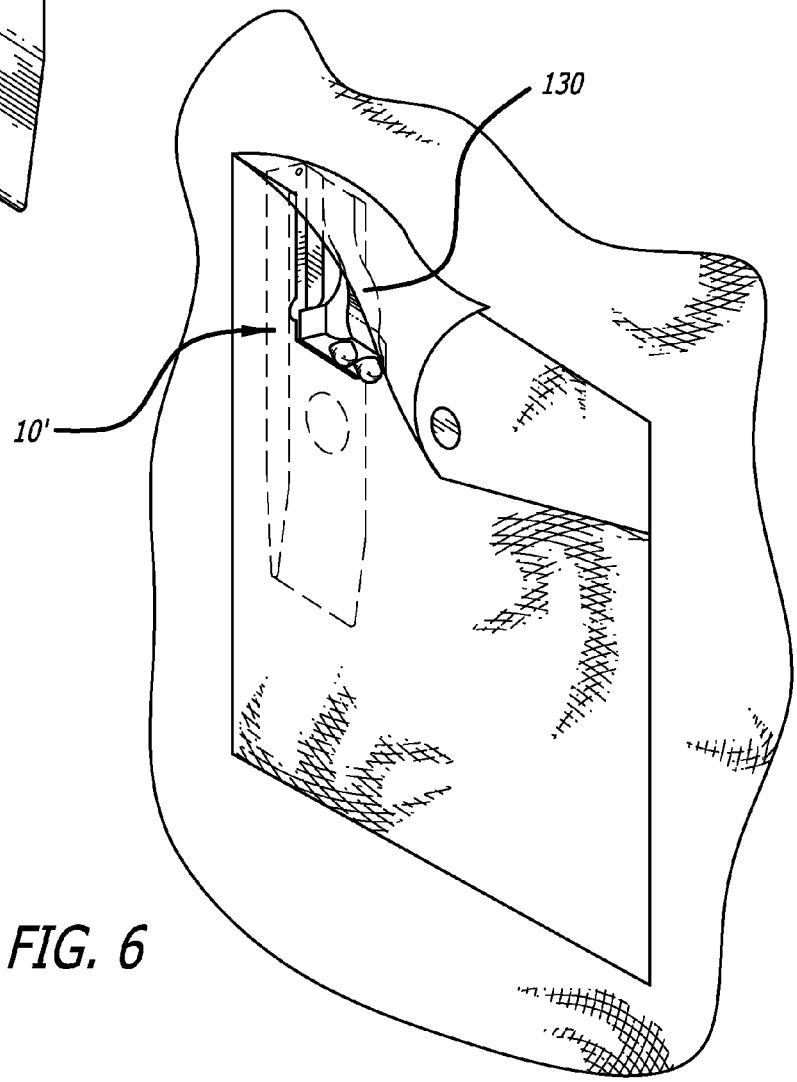
FIG. 6 is an environmental view of a second embodiment of the present invention having two LED lamps, showing the device positioned underneath a shirt pocket flap.

FIG. 6 shows a second embodiment of the invention (10') placed within a shirt pocket, with the flap of the shirt pocket partially lifted at its corner to partially reveal the device. In this embodiment there are two separate LED lamps provided on pocket light (10'). Pressing the power switch once causes one lamp to be illuminated; pressing the power switch a second time causes both lamps to be illuminated; and pressing the power switch a third time causes both lamps to turn off. As with both embodiments, the thinness of the overall design, particularly when combined with the tapered shape of outer member (130), allows the shirt pocket flap to hang over the portion of pocket light (10') that hangs outside the pocket while concealing that portion, but still allowing light from the LEDs to shine downward and slightly outward to illuminate the area immediately in front of the user such as a driver's license that a police officer is examining.

Figure 7:
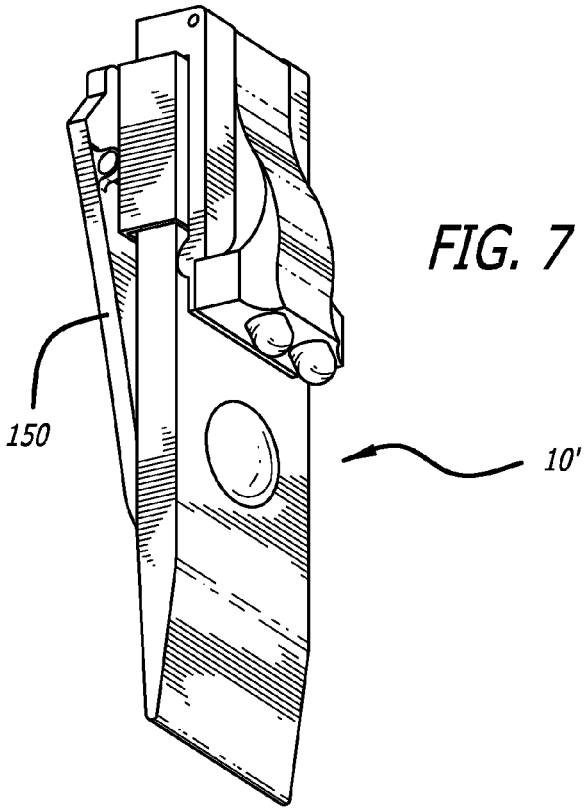
FIG. 7 is a perspective view of the second embodiment of the present invention with an optional clip.

FIG. 7 shows the embodiment of FIG. 6 with an optional detachable clip (150). As illustrated more clearly in FIG. 9, detachable clip (150) has a pair of holding arms (152 and 154) that define a receiving channel (156) for holding main body (50), preferably in a friction fit, therebetween. Detachable clip (150) further includes a spring biased hinge (158) and a clip arm (160) which is spring biased toward pocket light (10'). Detachable clip (150) allows pocket light (10') to be firmly mounted to a wide variety of objects. As can be seen in the figure, the two LEDs, which are not covered in the embodiment shown, have respective distal most extents (23, 24) that each extend beyond the distal most extents of respective immediately adjacent portions (133, 134) of outer member (131). In the embodiment shown, the distal most extents (23, 24) of the two LEDS in fact extend distally beyond any portion of outer member (131). As can be further seen in the figure, the two LEDs are mounted equidistant from hinge (94), and are also mounted equidistant from main body (50) which allows for a very low profile design. The distal most extent (23) of the LED on the left hand side of FIG. 7 is seen most clearly in FIG. 8.

As can be further seen in FIG. 7 as well as other figures, in this embodiment outer member (130) has a thickest portion proximate its distal end (131) where the at one least LED is mounted, in order to accommodate the LED.

Figure 8:
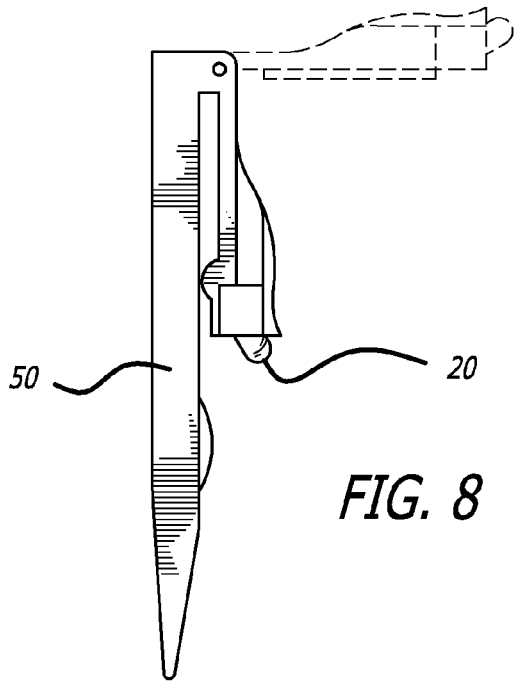
FIG. 8 is a side elevation view of the second embodiment of the present invention, with phantom lines used to illustrate the lamp portion being rotated up and away from the main body of the flashlight.
Figure 9:
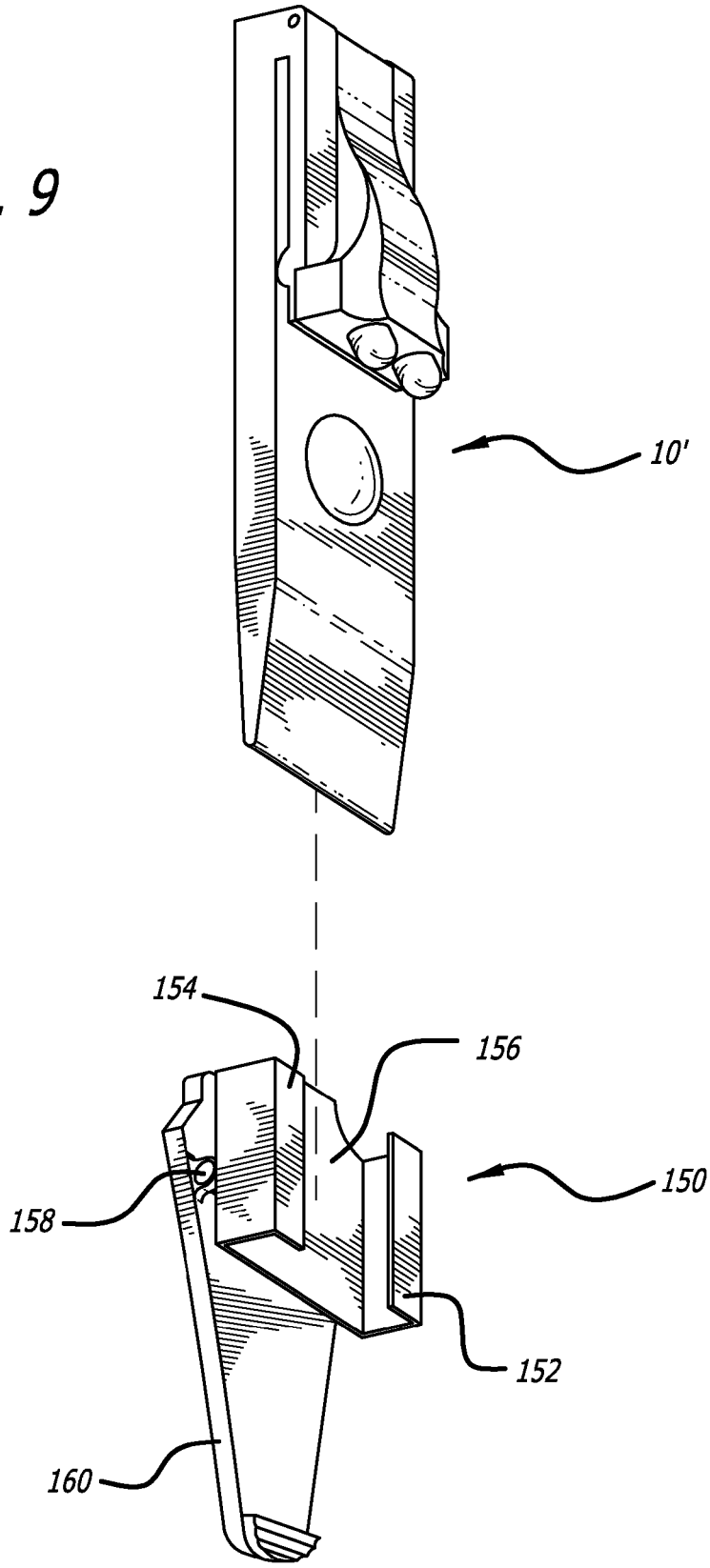
FIG. 9 is a perspective view of the second embodiment, showing the flashlight separated from the optional clip.

FIG. 8 is a side elevation view of either the pocket light (10) of FIG. 5 or the pocket light (10') of FIG. 6. The phantom lines illustrate outer member (130) rotated upward and away from main body (50).

As can be seen in the figures, when rotatable member 130 is rotated from an upward position shown in FIG. 3 into its fully downward position shown in FIGS. 1, 5, and 8, rotatable member 130 fits at least partially into a recess defined in part by the space between clip arms 81 and 82, and further defined in part by an inward step at the end of clip arms 81 and 82 as seen most clearly in FIG. 8, in order to reduce the overall thickness of the flashlight.

For most consumer uses, the lamp or lamps will preferably be white LEDs. In other embodiments, however, the light source can emit other than visible light. For example, the single lamp can be a white LED, a red LED in order to help preserve a user's night vision, an infrared (IR) LED for police and military night vision purposes, or an ultraviolet (UV) LED. A UV LED can be useful for a bouncer to view hands stamped with UV visible ink, for a police officer to view the UV visible ink used in driver's licenses, and many other purposes in which UV light is desired. The dual LED embodiment can use any combination of the foregoing types of lamps, with the sequential activation feature allowing the user to cycle between the different types of lights. In such a sequential activation of different types of lights, in most cases it would be desirable to cycle through the sequence of one type of lamp being on, the other type of lamp being on, and neither lamp being on, and would probably be undesirable in most cases, although not necessarily all cases, to include a state in which lamps of different types are turned on simultaneously. The invention is not limited to use of only one or two lamps, but could include any combination of lamps being sequentially activated, such as a white LED, a red LED, an IR LED, and then a UV LED in any sequence, or activated by two or more switches. Of course, the lamps need not be LEDs, and could be other types of light emitting members including light emitting members that have not yet been invented or have not yet come into widespread use.

It will be appreciated that the term "present invention" as used herein should not be construed to mean that only a single invention having a single essential element or group of elements is presented. Similarly, it will also be appreciated that the term "present invention" encompasses a number of separate innovations which can each be considered separate inventions. Although the present invention has thus been described in detail with regard to the preferred embodiments and drawings thereof, it should be apparent to those skilled in the art that various adaptations and modifications of the present invention may be accomplished without departing from the spirit and the scope of the invention. For example, the lamp could be another type of light emitting member other than an LED, different types of batteries could be used, different materials could be used, and other modifications may be made that would be within the skill of a mechanical designer and/or electrical designer. Accordingly, it is to be understood that the detailed description and the accompanying drawings as set forth hereinabove are not intended to limit the breadth of the present invention, which should be inferred only from the following claims and their appropriately construed legal equivalents.

I claim:

1. A compact flashlight comprising:

a main body containing a battery;

a rotatable member; and a hinge connected to the main body and to the rotatable member proximate respective top ends of said main body and said rotatable member;

wherein:

the rotatable member is about half as long as said main body, the rotatable member having a light emitting diode (LED) mounted proximate a distal end thereof; and when the rotatable member is rotated to its fully downward position, the rotatable member fits at least partially within a recess within the flashlight so as to reduce an overall thickness of the flashlight.

2. The compact flashlight of claim 1 wherein said main body has a chisel-shaped bottom end.

3. The compact flashlight of claim 1 wherein said recess is formed at least partially by a space between two clip arms.

4. The compact flashlight of claim 1 wherein said LED is mounted at an angle such that when said rotatable member is rotated to its fully downward position, said uncovered LED is angled outward from said main body.

5. The compact flashlight of claim 1 wherein said rotatable member is thickest proximate said uncovered LED to accommodate said LED.

6. The compact flashlight of claim 1 wherein said main body and said rotatable member have a combined thickness that is less than a length of said main body and less than a width of said main body.

7. A flashlight comprising:

a main body containing a battery;

a rotatable member rotatably connected to the main body and having at least one uncovered light emitting diode (LED) mounted proximate a distal end thereof, said rotatable member being thickest proximate said LED to accommodate said LED; and a switch for selectively electrically connecting the battery to said LED to provide electrical power thereto.

8. The flashlight of claim 7 wherein said at least one uncovered LED constitutes exactly one uncovered LED.

9. The flashlight of claim 7 wherein said main body has a chisel shaped bottom end.

10. The flashlight of claim 7 wherein said rotatable member is about half as long as said main body.

11. The flashlight of claim 7 wherein said main body and said rotatable member have a combined thickness that is less than a length of said main body and less than a width of said main body.

12. The compact flashlight of claim 7 wherein the uncovered LED is disposed on the rotatable member between a first surface of the rotatable member that is closest to the main body and a second surface of the rotatable member that is farthest from the main body when the rotatable member is rotated to its fully downward position.

13. The compact flashlight of claim 7 wherein said LED is mounted at an angle such that when said rotatable member is rotated to its fully downward position, said uncovered LED is angled outward from said main body.

14. A compact flashlight comprising:

a main body containing a battery;

a rotatable member approximately half as long as the main body, the rotatable member being rotatably connected to the main body proximate respective top ends thereof; and an uncovered light emitting diode (LED) mounted proximate a distal end of the rotatable member;

wherein the rotatable member is thickest proximate the uncovered LED to accommodate the uncovered LED.

15. The compact flashlight of claim 14 wherein the main body and the rotatable member have a combined thickness that is less than a length of the main body and less than a width of the main body.

16. The compact flashlight of claim 14 wherein the main body is small enough to fit within a shirt pocket, and the rotatable member is small enough to be concealed by a flap of the shirt pocket.

17. A method comprising placing the flashlight of claim 16 within a shirt pocket with the main body disposed within the pocket and the rotatable member disposed outside the pocket, the pocket flap hanging over the rotatable member.

18. The compact flashlight of claim 14 wherein the uncovered LED is angled away from the main body.

19. The compact flashlight of claim 18 wherein the uncovered LED is disposed on the rotatable member between a first surface of the rotatable member that is closest to the main body and a second surface of the rotatable member that is farthest from the main body when the rotatable member is rotated to its fully downward position.

20. The compact flashlight of claim 14 wherein the uncovered LED is disposed on the rotatable member between a first surface of the rotatable member that is closest to the main body and a second surface of the rotatable member that is farthest from the main body when the rotatable member is rotated to its fully downward position.

* * * * *